United States Patent [19]

Park

[11] Patent Number: 5,026,955

[45] Date of Patent: Jun. 25, 1991

[54] DRIVE CONTROL METHOD FOR AN ELECTROMAGNETIC INDUCTION HEATING APPARATUS

[76] Inventor: Myung J. Park, Wonmoon-Dong, Jukong Apt., 253-401 Kwacheon, Kyunggi-Do, Rep. of Korea

[21] Appl. No.: 302,468

[22] Filed: Jan. 27, 1989

[30] Foreign Application Priority Data

Jan. 29, 1988 [KR] Rep. of Korea ..... 745/1988

[51] Int. Cl.[5] ..... H05B 6/08

[52] U.S. Cl. ..... 219/10.41; 219/10.493; 219/10.77

[58] Field of Search ..... 219/10.77, 10.41, 10.75, 219/10.493; 266/96, 97

[56] References Cited

U.S. PATENT DOCUMENTS 3,775,577 11/1973 Peters, Jr. ..... 219/10.77

3,919,621 11/1975 Wechsler ..... 219/10.77

4,564,733 1/1986 Karklys ..... 219/10.77

4,749,836 6/1988 Matsuo et al. ..... 219/10.77

*Primary Examiner*—Philip H. Leung

[57] ABSTRACT

A method for controlling the drive of an electromagnetic induction heating apparatus jointly utilizing a time control method and a linear control method. The method includes the steps of storing pulse signals and reset pulse signals in addresses of a memory of a microprocessor, short-circuiting an ON/OFF switch by storing pulse signals of different widths in addresses of the memory, controlling a power transistor by a time control method when the power level is below a predetermined level, and controlling the power transistor by a linear control method when the power level is above a predetermined level. Thereby, a flicker effect and noise as prevented from being generated.

7 Claims, 3 Drawing Sheets

FIG, 1

DRIVE CONTROL METHOD FOR AN ELECTROMAGNETIC INDUCTION HEATING APPARATUS

BACKGROUND OF THE INVENTION

The present invention relates to an electromagnetic induction heating apparatus which heats a magnetic vessel with a magnetic force that is generated by switching on the current flow in a working coil in order to cook food contained in the magnetic vessel. More particularly, the present invention relates to a method for controlling the drive of an electromagnetic induction heating apparatus, that is, an electromagnetic heating cooker, which is designed to control the drive of a power transistor by commonly utilizing a time control method and a linear control method according to the power level selected by a user.

In order to control the apparatus drive, a conventional electromagnetic induction heating apparatus, a time control method varies the number of times that a power transistor is switched ON/OFF according to the power setting level, while the power control level is maintained constant on one hand. On the other hand, a linear control method varies the ON/OFF switching time of a power transistor by changing the power control level according to the power setting level.

However, in case where the former method is adopted because the power control level is constant, the ON/OFF switching time of the power transistor is constant. Thereby, a so-called "flicker effect" may be generated when the power control level is high.

On the other hand, in the case where the latter method is adopted, the above stated "flicker effect" does not occur. However, an extreme amount of noise is generated when the power control level is low since the switching frequency varies upon the change of the ON/OFF switching time of the power transistor.

SUMMARY OF THE INVENTION

Therefore, an object of the present invention is to provide a method for controlling the drive of an electromagnetic heating apparatus in order to present the flicker effect and noise irrespective of high and low values power control level of a power transistor.

The above object of the present invention is accomplished by controlling the ON/OFF switching of a power transistor with the time control method in the case where the power level established by a user is below a predetermined level, such as, below 600 watts for example, and controlling the ON/OFF switching of the power transistor with a linear control method in the case where the power level established by a user is above a predetermined level, such as, over 700 watts for example.

BRIEF DESCRIPTION OF THE DRAWINGS

The above and other objects, features and advantages of the present invention will become more apparent from the following detailed description taken in conjunction with the accompanying drawings, in which.

DETAILED DESCRIPTION OF THE INVENTION

Figure 1:
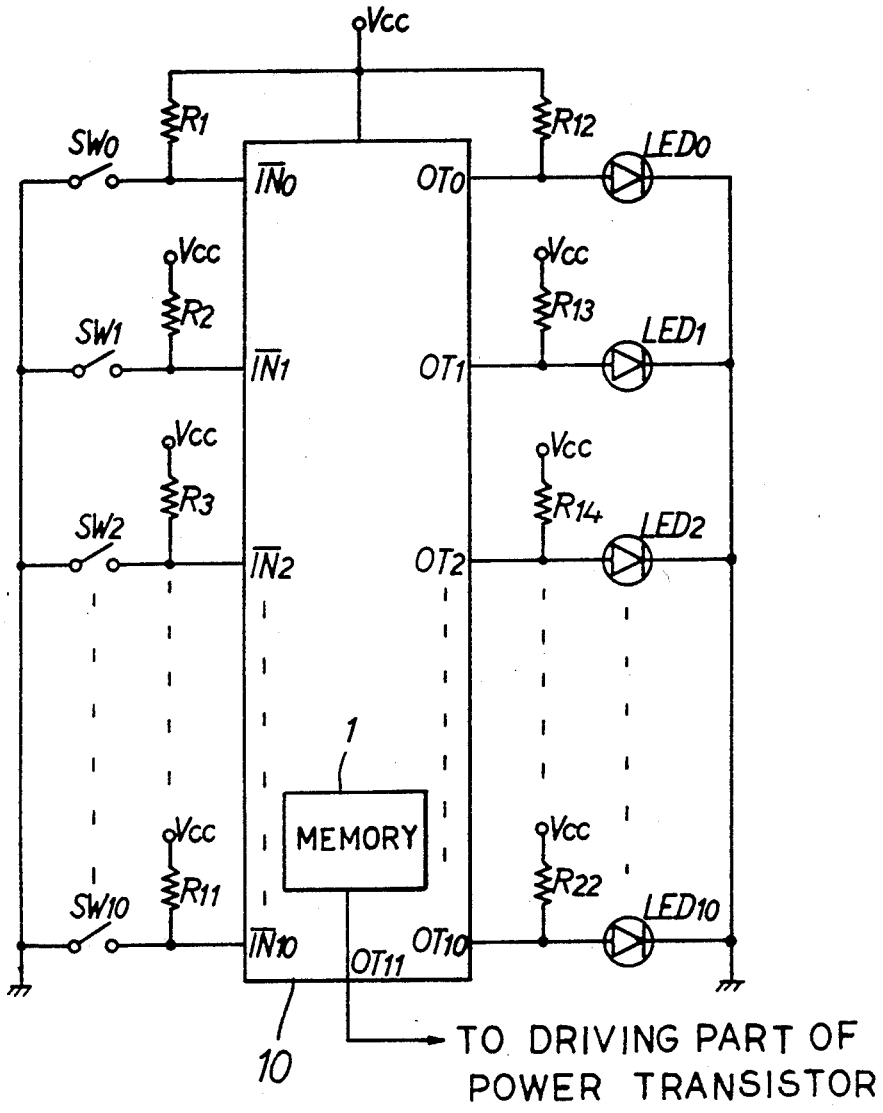
FIG. 1 is a circuit diagram illustrating the drive control method for a embodiment of the present invention.

Referring to FIG. 1, a circuit diagram of an electromagnetic induction heating apparatus is illustrated for the drive control method for an embodiment of the present invention. The circuit is constructed in a manner such that an ON/OFF switch SW0 and power level setting switches SW1–SW10 are connected in common with resistors R1–R11 that are connected to Vcc power terminals and input terminals $\overline{\text{IN}}$0–$\overline{\text{IN}}$10 of a micro-processor 10, respectively. Output terminals OT-0–OT10 of the micro-processor 10 are connected in common with resistors R12–R22 and light emitting diodes LED0–LED10, respectively and the resistors R12–R22 are connected to Vcc power terminals. Predetermined data signals are stored in a memory 1 of the micro-processor 10 according to the respective setting level so that the data signals are output from an output terminal OT1 of the micro-processor 10 in response to closing the power level setting switches SW1–SW10. Then, the signals are applied to a digital/analog converter of a driving part of the power transistor.

Referring to FIGS. 2(A) to (J), the waveforms of the data signals stored in the memory 1 of FIG. 1 according to each of the power setting levels are illustrated. In an address "0" of the memory 1, a low potential signal is stored. In addresses "1–6" pulse signals having a predetermined width T0 and reset pulse signals, as illustrated in FIGS. 2(A)–(F), are stored at the predetermined time differences t1–t6 from the point of time that the output of the pulse signals is finished.

Thereby, the data signals stored in the addresses "0–6" of the memory 1 are repeatedly output at a constant period Tt when low potential signals are input to the input terminals $\overline{\text{IN}}$0–$\overline{\text{IN}}$6.

In the addresses "7–10" of the memory 1, pulse signals having, the predetermined widths T7–T10 are different from each other, as illustrated in FIGS. 2(G)–(J), are stored. Thereby the pulse signals stored in the addresses "7–10" of the memory 1 are output, respectively, when low potential signals are input to the input terminals $\overline{\text{IN}}$7–$\overline{\text{IN}}$10 of the micro-processor 10.

The operation and effect of the present invention will now be described in detail with reference to FIG. 3.

Figure 3:
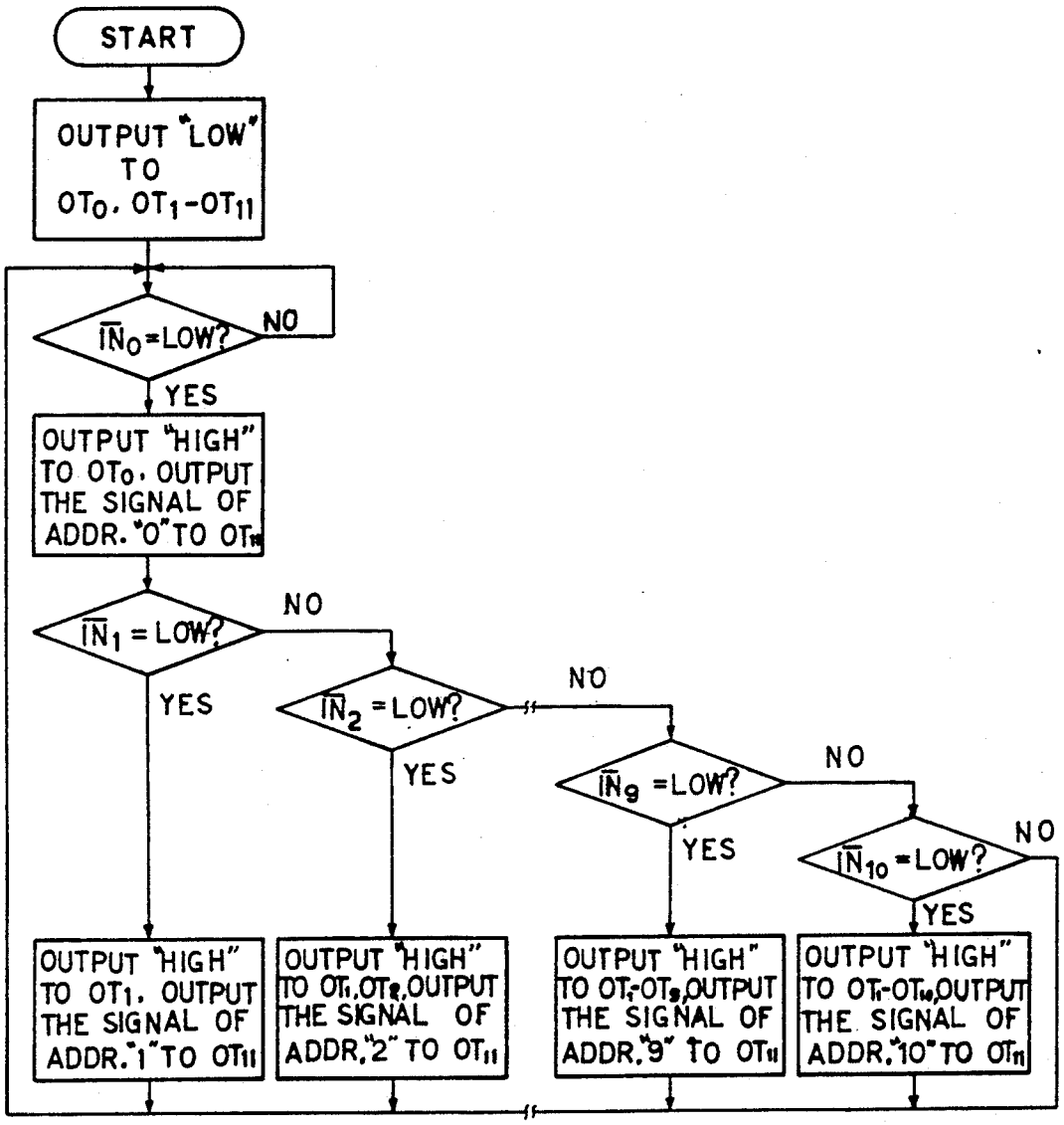
FIG. 3 is a flow-chart of the micro-processor illustrating the drive control method for an embodiment of the present invention.

When power is applied to the Vcc power terminal, the microprocessor 10 outputs low potential signals through the output terminals OT0–OT11 as illustrated in FIG. 3. Under such a state, when a user closes an ON/OFF switch SW0 and a low potential signal is applied to an input terminal IN0 of the micro-processor 10, the micro-processor 10 outputs through a high potential signal through the output terminal OT0 and turn on a light emitting diode LED0. At the same time, a low potential signal stored in the address "0" of the memory 1 is through the output terminal OT11.

Under this state, when a low potential signal is applied to the input terminal $\overline{\text{IN}}$1 of the micro-processor 10 by closing a power level setting switch SW1 by a user, the micro-processor 10 outputs a high potential signal through the output terminal OT1 to light a light emitting diode LED1. At the same time, the data signal stored in the address "1" of the memory is output through the output terminal OT11 and then is applied to a digital/analog converter of the driving part of the power transistor.

Figure 2:
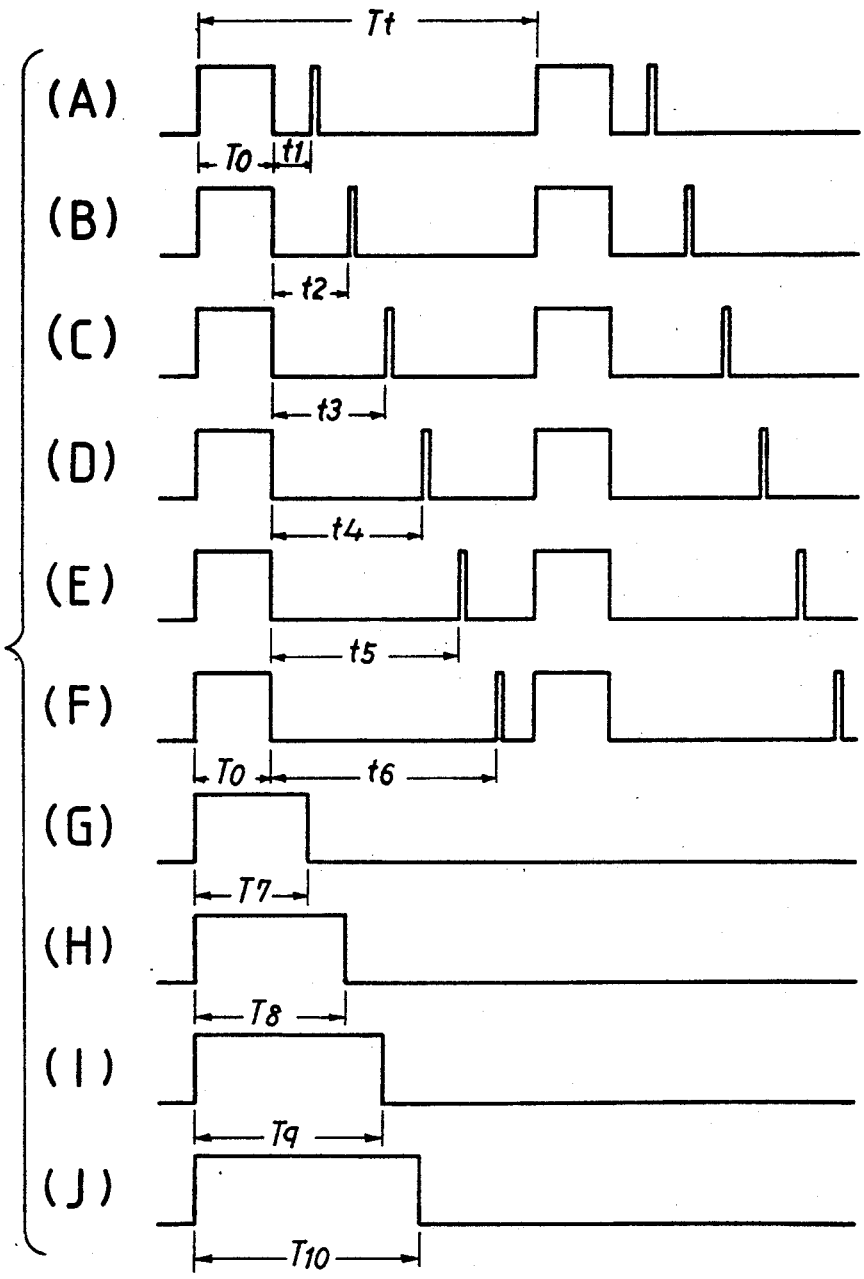
FIGS. 2(A) to 2(J) are waveforms of the data signals stored in the micro-processor of FIG. 1.

That is to say, after outputting a high potential signal during a predetermined time T0 as shown in FIG. 2(A), the micro-processor 10 repeats the process and outputs reset pulse signals at a constant period Tt after a predetermined time t1. Accordingly, ON and OFF operations of the power transistor are repeated during the times T0 and t1 at a constant power level.

Similarly, when a user closes one of the power level setting switch is SW2, SW3, SW4, SW5 or SW6 so that a low potential signal is input to an input terminal $\overline{IN2}$, $\overline{IN3}$, $\overline{IN4}$, $\overline{IN5}$ or $\overline{IN6}$ of the micro-processor 10, the micro-processor 10 outputs high potential signals through the output terminals OT1, OT2; OT1-OT3; OT1-OT4; OT1-OT5 or OT1-OT6 to light the light emitting diodes LED1, LED2; LED1-LED3; LED-1-LED4; LED1-LED5 or LED1-LED6. At the same time, the data signals stored in the address "2", "3", "4", "5" or "6" of the memory are applied from the output terminal OT11 to the digital/analog converter of the driving part of the power transistor. That is to say, at this moment the micro-processor 10 outputs the waveform signals as shown in FIG. 2(B), (C), (D), (E) or (F) from the output terminal OT11 at a constant period Tt repeatedly. Thereby, the ON and OFF operations of the power transistor are repeated at a constant power level during the predetermined times T0+t2; T0+t3; T0+t3; T0+t5 or T0+t6.

Under the above described state where the ON/OFF switch SW0 is closed, when the power level setting switch SW1, SW2, SW3, SW4, SW5 or SW6 is closed, the waveform signal as illustrated in FIG. 2(A), (B), (C), (D), (E) or (F) is applied to the digital/analog converter of the driving part of the power transistor from the memory 1 of the micro-processor 10. Thereby the power transistor repeats the ON and OFF operations at a constant power level during the predetermined times T0+t1; T0+t2; T0+t3; T0+t4; T0+t5 or T0+t6.

That is, at this time the ON and OFF operation of the power transistor are controlled by the time control method.

On the other hand, a low potential signal may be applied to an input terminal IN7 of the micro-processor 10 by closing a power level setting switch SW7. The micro-processor 10 outputs high potential signals from the output terminals OT1-0T7 to light the light emitting diodes LED1-LED7, and at, the same time, outputs the data signal stored in the address "7" of the memory is output from the output terminal OT11. That is to say, a high potential signal is output during a predetermined time T7, as illustrated in FIG. 2(G), and the signal is applied to the digital/analog converter of the driving part of the power transistor. Thereby the power transistor is turned on and off at the power level in proportion to the time T7.

Similarly, when a low potential signal is applied to the input terminal IN8, IN9 or IN10 of the micro-processor 10 by closing the power level setting switch SW8 or SW9 by a user, the micro-processor 10 outputs high potential signals from the output terminals OT-1-OT8; OT1-OT9 or OT1-OT10 to light the light emitting diodes LED1-LED8; LED1-LED9 or LED-1-LED10, at the same time, the waveform signal stored in the address "8", "9" or "10" of the memory 1, as is applied as illustrated in FIG. 2(H), (I) or (J) to the digital/analog converter through the output terminal T11. Thereby, the ON and OFF operations of the power transistor are controlled at the power level in proportion to the predetermined time T8, T9 or T10.

That is to say, in the case of closing the power level setting switch SW7, SW8, SW9 or SW10. When the ON/OFF switch SW0 being is closed, the light emitting diodes LED1-LED7; LED1-LED8; LED1-LED9 or LED1-LED10 are turned on. At the same time the ON and OFF operations of the power transistor are controlled by the linear control method at the power level in proportion to the predetermined times of T7, T8, T9 or T10 that are different from each other.

As described above in detail, the present invention has an advantage of controlling the power transistor by a time control method when the power level established by a user is below a predetermined level and is controlled by a linear control method when the power level is over a predetermined level. Thereby, the flicker effect and noise are prevented from being generated.

What is claimed is:

1. A method of controlling a power level of a power transistor in an electromagnetic induction heating apparatus, comprising the steps of:

storing a plurality of time control pulse signals in a microprocessor memory corresponding in number to a plurality of first power level setting switches, said time control pulse signals switching said power transistor at a plurality of power level frequencies;

storing a plurality of linear control pulse signals in said microprocessor memory corresponding in number to a plurality of second power level setting switches, said linear control pulse signals turning on said power transistor for a plurality of predetermined times;

selecting said power level of said apparatus responsive to an operator closing one of said plurality of first and second power level setting switches;

controlling said power level of said apparatus by outputting one of said plurality of time control pulse signals to said power transistor for switching said power transistor at one of said power level frequencies in response to an operator closing one of said first power level switches; and controlling said by outputting one of said plurality of linear control pulse signals to said power transistor for turning on said power transistor for one of said predetermined times in response to an operator closing one of said second power level setting switches.

2. A method according to claim 1, wherein a first light emitting diode is turned on in response to closing a power switch, and one of a plurality of second light emitting diodes corresponding in number to said first and second power level setting switches is turned on in response to closing one of said power level setting switches corresponding thereto.

3. A method according to claim 1, wherein said plurality of time control pulse signals comprise a first predetermined pulse width and each of said time control pulse signals comprise a reset pulse at a plurality of predetermined intervals from said first predetermined pulse width.

4. A method according to claim 1, wherein said plurality of linear control pulse signals comprise a plurality of second predetermined pulse widths.

5. A method of controlling a selected power level of an electromagnetic induction heating apparatus comprising the steps of:

time controlling said apparatus by switching a power transistor at a predetermined frequency in response to said selected power level being below a predetermined power level; and linear controlling said apparatus by turning on said power transistor for a predetermined time in response to said selected power level being above said predetermined power level.

6. In an induction heating apparatus comprising an induction heating coil for heating a load, power supply means for supply power to said apparatus, and control means for controlling said power supplied to said induction heating coil, said control means including microprocessor for developing a control signal and a power transistor for controlling said power responsive to said control signal, said microprocessor including a memory heaving a plurality of addresses, a method of controlling the drive of said apparatus comprising the steps of:

storing each of a plurality of time control pulse signals in one of said addresses of said memory, said time control pulse signals corresponding in number to a plurality of first power level setting switches for switching said power transistor to a plurality of power level frequencies;

storing each of a plurality of linear control pulse signals in one of said addresses of said memory, said linear control pulse signals corresponding in number to a plurality of second power level setting switches for turning on said power transistor for a plurality of predetermined times;

selecting said power of said apparatus responsive to a operator closing one of said plurality of first and second power level setting switches;

controlling said power to said apparatus by outputting one of said plurality of time control pulse signals as said control signal to said power transistor in response to an operator closing one of said first power level setting switches; and controlling said power to said apparatus by outputting one of said plurality of linear control pulse signals as said control signal to said power transistor in response to an operator closing one of said second power level setting switches.

7. An induction heating apparatus comprising:

an induction heating coil for heating a load;

power supply means for supplying power to said apparatus;

a microprocessor having a memory with a plurality of addresses for developing a control signal, said microprocessor including, first storing means for storing each of a plurality of time control pulse signals in one of said addresses of said memory, said time control pulse signals corresponding in number to a plurality of first power level setting switches, and second storing means for storing each of a plurality of linear control pulse signals in one of said addresses of said memory, said linear control pulse signals corresponding in number to a plurality of second power level setting switches;

selecting means for selecting said power to said heating coil responsive to an operator closing one of said plurality of first and second power level setting switches;

first controlling means for controlling said power to said apparatus by outputting one of said plurality of time control pulse signals as said control signal to said power transistor in response to an operator closing one of said first power level setting switches for switching said power transistor at one said power level frequency corresponding to said one first power level setting switch; and second controlling means for controlling said power to said apparatus by outputting one of said plurality of linear control pulse signals as said control signal to said power transistor in response to an operator closing one of said second power level setting switches for turning on said power transistor for one said predetermined time corresponding to said one second power level setting switch.

* * * * *